US008696093B2

(12) United States Patent
Ozawa et al.

(10) Patent No.: US 8,696,093 B2
(45) Date of Patent: Apr. 15, 2014

(54) LIQUID EJECTING HEAD AND LIQUID EJECTING APPARATUS

(71) Applicant: Seiko Epson Corporation, Tokyo (JP)

(72) Inventors: Kinya Ozawa, Shiojiri (JP); Ryosuke Tsuchihashi, Matsumoto (JP); Shushi Makita, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/777,115

(22) Filed: Feb. 26, 2013

(65) Prior Publication Data

US 2013/0222487 A1 Aug. 29, 2013

(30) Foreign Application Priority Data

Feb. 27, 2012 (JP) ..... 2012-039533
Feb. 28, 2012 (JP) ..... 2012-041933

(51) Int. Cl.
*B41J 2/045* (2006.01)

(52) U.S. Cl.
USPC ..... 347/71

(58) Field of Classification Search
USPC ..... 347/71
See application file for complete search history.

(56) References Cited

U.S. PATENT DOCUMENTS

| | | | |
|---|---|---|---|
| 2005/0018018 | A1 | 1/2005 | Aschoff et al. |
| 2006/0207720 | A1 | 9/2006 | Yoshizawa et al. |
| 2008/0049075 | A1 | 2/2008 | Ito |
| 2011/0234707 | A1 | 9/2011 | Gao |

FOREIGN PATENT DOCUMENTS

| | | |
|---|---|---|
| JP | 2004-082501 | 3/2004 |
| JP | 2006-291167 | 10/2006 |
| JP | 2008-049586 | 3/2008 |
| JP | 2011-194783 | 10/2011 |

OTHER PUBLICATIONS

Extended European Search Report for Application No. EP 13 15 6813 mailed Jun. 14, 2013 (5 pages).

*Primary Examiner* — Alessandro Amari
*Assistant Examiner* — Michael Konczal
(74) *Attorney, Agent, or Firm* — Harness, Dickey & Pierce, P.L.C.

(57) ABSTRACT

A liquid ejecting head includes a nozzle; a pressure chamber communicating with the nozzle; a pressure chamber substrate having pressure chambers defined by partition walls; a pressure generator generating pressure change in liquid inside the pressure chamber; and a bottom joined to the pressure chamber substrate by adhesive; and an organic solvent-based ink ejected from the nozzle by driving a piezoelectric element and generating the pressure change in the pressure chamber, and when a width of the pressure chamber in an arrangement direction of the pressure chambers is W and a width of the adhesive in the arrangement direction of the pressure chambers in a state where the adhesive has flowed out from between a lower end portion of the partition wall and the bottom to the pressure chamber side and is then solidified is L, the following expression is satisfied, $0.05 \leq L/W \leq 0.3$.

10 Claims, 4 Drawing Sheets

| L/W | 0 | 0.02 | 0.04 | 0.05 | 0.08 | 0.1 | 0.2 | 0.3 | 0.4 | 0.5 |
|---|---|---|---|---|---|---|---|---|---|---|
| CT RATE | 50 | 40 | 35 | 30 | 25 | 25 | 20 | 20 | 20 | 20 |
| OUTFLOW | ◎ | ◎ | ◎ | ◎ | ◎ | ○ | ○ | ○ | △ | × |

LIQUID EJECTING HEAD AND LIQUID EJECTING APPARATUS

The entire disclosure of Japanese Patent Application Nos. 2012-039533, filed Feb. 27, 2012 and 2012-041933, filed Feb. 28, 2012 are expressly incorporated by reference herein.

BACKGROUND

1. Technical Field

The present invention relates to a liquid ejecting head installed in a liquid ejecting apparatus such as an ink jet type recording apparatus and a liquid ejecting apparatus having the liquid ejecting head, and more particularly, to a liquid ejecting head which ejects a liquid from a nozzle by generating a pressure change in the liquid inside a pressure chamber by deforming an operation surface configuring a portion of the pressure chamber communicating with the nozzle and a liquid ejecting apparatus.

2. Related Art

A liquid ejecting apparatus includes a liquid ejecting head capable of ejecting a liquid from a nozzle as a liquid droplet and is an apparatus which ejects various types of liquids from the liquid ejecting head. As a typical example of the liquid ejecting apparatus, for example, an image recording apparatus such as an ink jet type recording apparatus (a printer) may be exemplified which includes an ink jet type recording head (hereinafter, referred to as a recording head) and performs recording by ejecting the liquid ink from the nozzle of the recording head as the ink droplet. Furthermore, the liquid ejecting apparatus is used to eject various types of liquids such as a color material used in a color filter of a liquid crystal display or the like, an organic material used in an organic Electro Luminescence (EL) display, an electrode material used for formation of the electrode and the like. Then, a liquid ink is ejected from the recording head for the image recording apparatus and a solution of each color material of Red (R), Green (G) and Blue (B) is ejected from a color material ejecting head for the display manufacturing apparatus. In addition, a liquid electrode material is ejected from an electrode material ejecting head for the electrode forming apparatus, and solution of the bioorganic matter is ejected from a bioorganic matter ejecting head for the chip manufacturing apparatus.

The recording head provided in the printer described above is configured such that the pressure change in the ink inside the pressure chamber is generated by introducing the ink from an ink supply source such as an ink cartridge into a pressure chamber (a pressure generation chamber) and by operating the pressure generation unit such as a piezoelectric element or a heating element, and then the ink inside the pressure change is ejected from the nozzle as an ink droplet using the pressure change (see, for example, JP-A-2011-194783). The recording head described above corresponds to the improved quality of the recording image and a plurality of nozzles are disposed in a high density (for example, a pitch corresponding to 360 dpi). Accordingly, the pressure chamber communicating with each of the nozzles is also formed in a high density and, as a result, a partition wall defining adjacent pressure chambers or each of flow paths other than the pressure chambers is likely to be very thin.

Here, for example, when the ink is ejected from a nozzle, the partition wall may be displaced to the pressure chamber side by the pressure change in the ink inside the pressure chamber due to the driving of the pressure generation unit. Regarding this point, the adhesive is swollen by the ink that is used and then the bonding strength thereof may be reduced in a configuration in which a substrate forming the pressure chamber and a member, for example, a nozzle plate, which is laminated on the substrate and defines a bottom portion of the pressure chamber, are joined by the adhesive. In this case, a fixing force of the lower end of the partition wall of the pressure chamber is decreased. Thus, there are concerns that when the pressure change is generated inside the pressure chamber while the ink is ejected from the nozzle, crosstalk may be generated that the partition wall is easily displaced by the pressure, loss of the pressure is as much generated, and ejection characteristics of the ink droplet such as decrease of flying speed of the ink droplet, decrease of the amount of the ink droplet, and the like are changed. In other words, when the ink is ejected from a plurality of nozzles adjacent each other, at the same time (when all is ON) and when the ink is ejected from one nozzle (when one is ON) alone (a state where the ink is not ejected from the adjacent nozzles, at the same time), the ejection characteristics such as the amount or the flying speed of the ink are varied.

In the related art, the liquid ejecting head has been used to eject an organic solvent-based (solvent-based) ink with enhanced weather resistance, more than the conventional water-based ink, is ejected. The organic solvent-based ink is likely to cause swelling of the adhesive compared to the water-based ink. In addition, the compressibility (the amount that indicates the degree of the change with respect to the original volume when the pressure of 1 [Pa] is applied under constant temperature) of the organic solvent-based ink is greater than the compressibility of water or water-based ink under the same environmental condition (the temperature and the atmosphere). In ejecting the ink having the compressibility greater than that of the water described above, there is a problem that deterioration of the crosstalk described above is further remarkable. In other words, as described above, in a case where the pressure inside the pressure chamber is increased and then the pressure acts on the partition wall, when the ink filled in the adjacent pressure chambers is the organic solvent-based ink, the reaction force of the organic solvent-based ink against the partition wall is small compared to the water-based ink. Thus, the partition wall is easily displaced (deformed) by the adjacent pressure chambers, and, as a result, the crosstalk is deteriorated.

In addition, the problems described above exist in the ink jet type recording apparatus having the recording head ejecting the ink and also exist in another liquid ejecting head and another liquid ejecting apparatus in which the liquid is ejected from the nozzle by driving the pressure generation unit and by generating the pressure change in the liquid inside the pressure chamber.

SUMMARY

An advantage of some aspects of the invention is to provide a liquid ejecting head and a liquid ejecting apparatus capable of suppressing crosstalk when the liquid is ejected.

According to an aspect of the invention, there is provided a liquid ejecting head including: a pressure chamber substrate in which a plurality of pressure chambers communicating with nozzles are defined by partition walls; a pressure generation unit which generates a pressure change in a liquid inside the pressure chamber; and a bottom member which is joined to the pressure chamber substrate by adhesive and defines the bottom portion of the pressure chamber, wherein the liquid having a compressibility greater than a compressibility of water is ejected from the nozzle by driving the pressure generation unit and by generating the pressure change in the pressure chamber, and wherein when a width of the pressure chamber in an arrangement direction of the pressure chambers is W and a width of the adhesive in the arrangement direction of the pressure chambers in a state where the adhesive is flowed out from between a lower end portion of the partition wall and the bottom member to the pressure chamber side and then is solidified in a corner portion which is defined by the partition wall and the bottom member is L, the following expression is satisfied, $0.05 \leq L/W \leq 0.3$.

In the aspect, when the width of the adhesive in the arrangement direction of the pressure chambers in a state where the adhesive is flowed out from between a lower end portion of the partition wall and the bottom member to the pressure chamber side and then is solidified in a corner portion which is defined by the partition wall and the bottom member is L, the following expression is satisfied, $0.05 \leq L/W \leq 0.3$. Accordingly, the bonding strength between the lower end portion of the partition wall and the bottom member is increased while preventing defects due to the outflow of the adhesive, that is, the defects that the adhesive regulates the operation of the pressure generation unit or the like. Thus, when the pressure change is generated inside the pressure chamber by driving the pressure generation unit to eject the liquid from the nozzle, the displacement of the partition wall is suppressed. Accordingly, when the liquid is ejected, the loss of the pressure is reduced and the crosstalk between adjacent nozzles is suppressed. In other words, the variation in the ejection characteristics (the amount and the flying speed of the liquid ejected from the nozzle) is suppressed.

Further, in the configuration described above, it is preferable that when the width of the partition wall in the arrangement direction of the pressure chambers is D and the height of the pressure chamber in the lamination direction of the pressure chamber substrate and the bottom member is H, the following expression be satisfied, $3.8 < H/D \leq 9.0$.

In the aspect, the strength of the partition wall itself is increased while sufficiently securing the ejection amount of the liquid. Accordingly, the crosstalk is further reliably suppressed.

Further, in the configuration described above, it is preferable that the following expression be satisfied, $0.7 < H/W \leq 1.6$.

Further, in the configuration described above, it is preferable that the liquid have an organic solvent as a solvent and a swelling rate of the adhesive be 10% or less when the adhesive is immersed in the liquid for 100 hours under a circumference of 40° C.

According to the configuration, the swelling rate of the adhesive is 10% or less when the adhesive is immersed in the liquid so that the swelling of the adhesive is suppressed and decrease of the bonding strength between the lower end portion of the partition wall and the bottom member is further suppressed. Accordingly, it contributes to the suppression of the crosstalk described above.

Further, in the configuration described above, it is preferable that the adhesive be made by an epoxy-based adhesive blended with silica of 5 wt % or more to 10 wt % or less.

According to the configuration, since the viscosity of the adhesive in a case of the adhesive blended with silica is increased compared to the case of the adhesive not blended with silica, the defects due to the outflow of the adhesive can be further reliably suppressed.

In addition, according to another aspect of the invention, there is provided a liquid ejecting apparatus including the liquid ejecting head according to any one of the configurations described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. In addition, in the embodiments described below, a variety of limitations are given as preferred specific examples of the invention, however, the range of the invention is not limited to the embodiments unless there is no description with a specific intention of limiting the invention. Furthermore, in the following description, an ink jet type recording apparatus (hereinafter, referred to as a printer 1) which has a recording head 2 that is a type of a liquid ejecting head is exemplified as the liquid ejecting apparatus of the invention.

Figure 1:
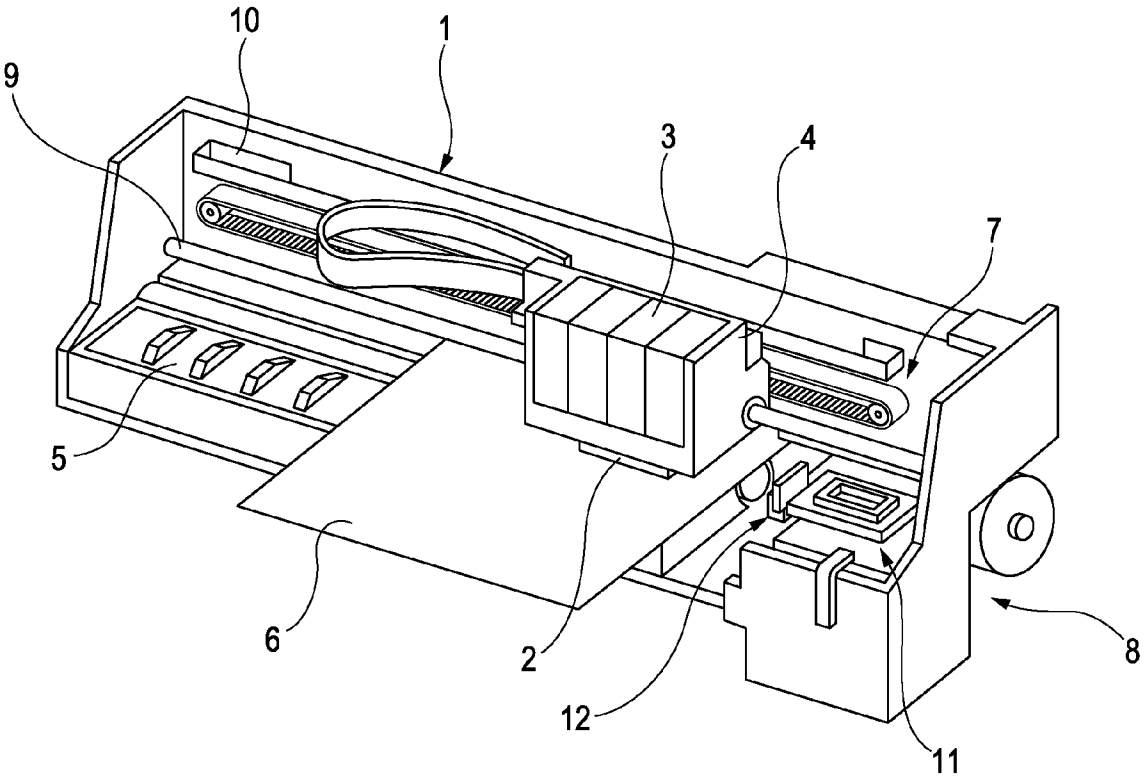
FIG. 1 is a perspective view explaining a configuration of a printer.

FIG. 1 is a perspective view illustrating a configuration of a printer 1. The printer 1 includes a carriage 4 in which the recording head 2 is installed and an ink cartridge 3 that is a type of a liquid supply source is detachably installed, a platen 5 which is disposed in the lower side of the recording head 2 when a recording operation is performed, a carriage moving mechanism 7 moving the carriage 4 reciprocally in a paper width direction of a recording paper 6 (a type of a recording medium and a landing object), that is, in a main scanning direction, and a paper transportation mechanism 8 transporting the recording paper 6 in a sub-scanning direction orthogonal to the main scanning direction.

The carriage 4 is installed in a guide rod 9 in a state of being pivotally supported on the guide rod 9 disposed in the main scanning direction and is configured to be moved in the main scanning direction along the guide rod 9 by the operation of the carriage moving mechanism 7. The position of the carriage 4 in the main scanning direction is detected by a linear encoder 10 and a detection signal thereof, that is, an encoder pulse is transmitted to a printer controller (not illustrated). The linear encoder 10 is a type of a position information output unit and outputs the encoder pulse depending on the scanning position of the recording head 2 as the position information in the main scanning direction.

A home position, which is a reference point of the scanning of the carriage, is set in an end region outside from a recording region within a moving range of the carriage 4. A capping member 11 which seals a nozzle forming surface (a nozzle forming substrate 15: see FIG. 2) of the recording head 2 and a wiper member 12 which sweeps the nozzle forming surface are disposed in the home position in the embodiment. Then, the printer 1 is configured to carry out so-called bi-directional recording which records characters, images and the like on the recording paper 6 in the bi-direction when the carriage 4 moves forward from the home position to an end portion of the opposite side and when the carriage 4 moves backward from the end portion of the opposite side to the home position.

Figure 2A:
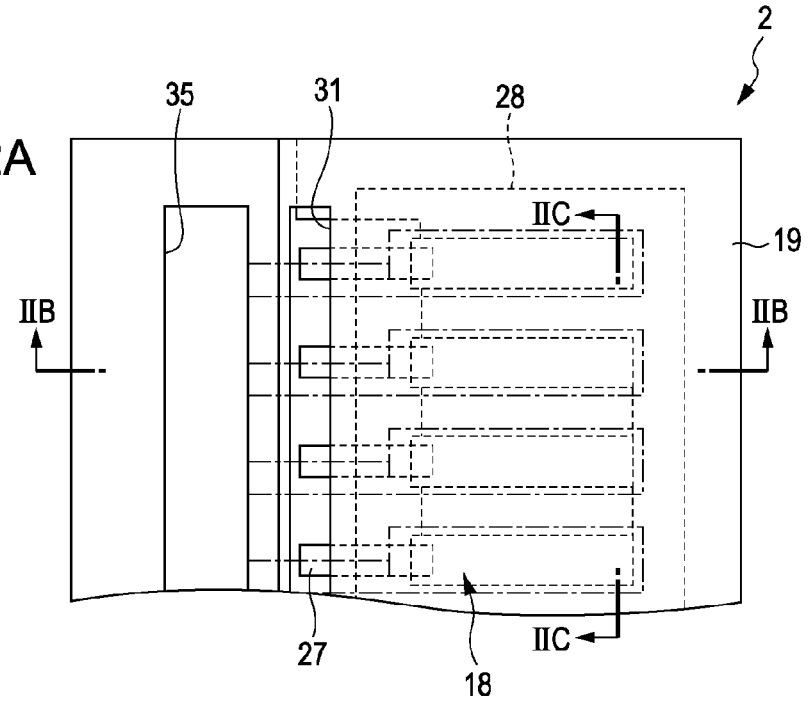
FIGS. 2A to 2C are views explaining a configuration of a recording head.
Figure 2B:
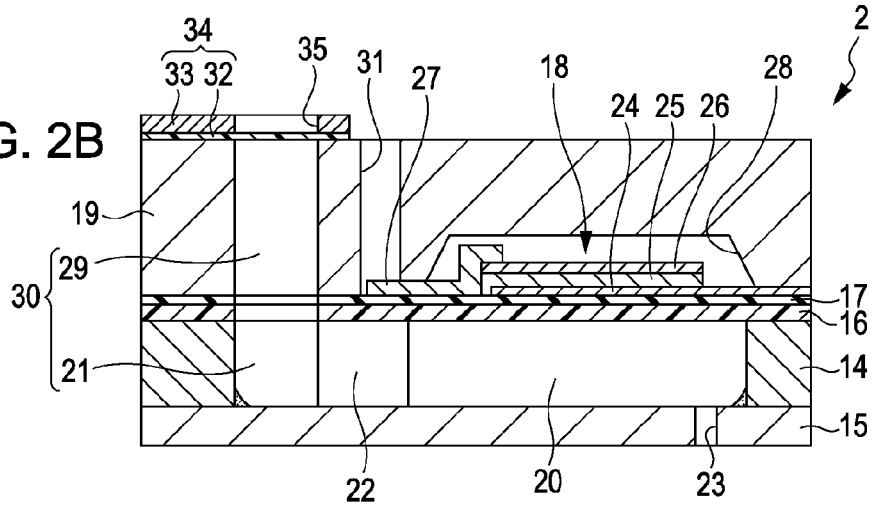
Figure 2C:
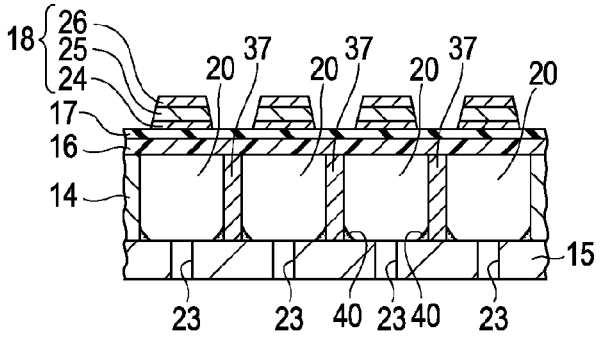

FIGS. 2A to 2C are views illustrating a configuration of the recording head 2 of the embodiment, FIG. 2A is a plan view of the recording head 2, FIG. 2B is a cross-sectional view which is taken along a line IIB-IIB in FIG. 2A and FIG. 2C is a cross-sectional view which is taken along a line IIC-IIC in FIG. 2A. In addition, a protection substrate 19 is not illustrated in FIG. 2C. Furthermore, a configuration of four nozzles is illustrated in FIGS. 2A to 2C, however, a configuration corresponding to the other remaining nozzles is similar to the above configuration. The recording head 2 in the embodiment is configured by laminating a pressure chamber substrate 14, the nozzle forming substrate 15, an elastic film 16, an insulating film 17, a piezoelectric element 18, the protection substrate 19 or the like.

The pressure chamber substrate 14 is a plate material formed of, for example, a silicon single crystal substrate. A plurality of pressure chambers 20 are arranged in the width direction (a nozzle row direction (a first direction)) thereof to be sandwiched between partition walls 37 in the pressure chamber substrate 14. In the embodiment, 360 pressure chambers 20 are formed per 1 inch. Then, a ratio H/D of the height H (the height of the partition wall 37) of the pressure chamber 20 and the thickness D of the partition wall 37 are set to be 9.0 or less in a range in which ejection efficiency (ejection amount of the ink per unit time) of the ink is not deteriorated. In addition, a ratio H/W of the width W (inside dimension of the pressure chamber in the arrangement direction) of the pressure chambers 20 and the height H of the pressure chamber 20 is set to be 1.6 or less in a range in which the ejection efficiency of the ink is not deteriorated. In addition, those relationships will be described below. Furthermore, the range in which the ejection efficiency of the ink is not deteriorated means that an amount of the ink per unit time ejected from a nozzle 23 is within a tolerance that is assumed on the specification of the printer 1 when the piezoelectric element 18 is driven by applying a predetermined voltage.

A communication section 21 is formed in a region outside the outer side of the opposite side of the side which communicates with the nozzle 23 in the longitudinal direction (a direction orthogonal to the nozzle row direction) of the pressure chamber 20 of the pressure chamber substrate 14. The communication section 21 communicates with each pressure chamber 20 via an ink supply path 22 which is provided in each pressure chamber 20. In addition, the communication section 21 communicates with a reservoir section 29 of the protection substrate 19 described below and then configures a portion of a reservoir 30 which is a common ink chamber of each pressure chamber 20. The ink supply path 22 is formed with a width which is narrower than that of the pressure chamber 20 and imparts a flow path resistance to the ink flowing from the communication section 21 to the pressure chamber 20. The flow paths such as the pressure chamber 20 and the ink supply path 22 in the pressure chamber substrate 14 are formed by anisotropic etching.

The nozzle forming substrate 15, in which a plurality of the nozzles 23 are opened in a row corresponding to each pressure chamber 20, is joined on the lower surface of the pressure chamber substrate 14 by adhesive 40. Accordingly, the opening of the lower surface side of the pressure chamber 20 is sealed by the nozzle forming substrate 15 and then the bottom portion of the pressure chamber 20 is defined. In other words, the nozzle forming substrate 15 in the embodiment functions as a bottom member in the invention. The junction between the pressure chamber substrate 14 and the nozzle forming substrate 15 will be described below. The elastic film 16 which is made of, for example, silicon dioxide ($SiO_2$), is formed on the upper surface of the pressure chamber substrate 14. A portion of the elastic film 16, which seals the opening of the pressure chamber 20, functions as an operation surface. In addition, the insulating film 17 which is made of zirconium oxide ($ZrO_2$) is formed on the elastic film 16. Furthermore, a lower electrode 24, a piezoelectric body 25 and an upper electrode 26 are formed on the insulating film 17, and the piezoelectric element 18 (a type of a pressure generation unit) is configured in a laminated state of these members.

Generally, either electrode of the piezoelectric element 18 is a common electrode and the other electrode (the positive electrode or an individual electrode) and the piezoelectric body 25 are patterned in each pressure chamber 20. Thus, a portion configured of either electrode and the piezoelectric body 25 which are patterned, and in which piezoelectric strain is generated by applying the voltage to both electrodes is referred to as a piezoelectric active part. In addition, in the embodiment, the lower electrode 24 is the common electrode of the piezoelectric element 18 and the upper electrode 26 is the individual electrode of the piezoelectric element 18, however, the above members may be entirely reversely configured by the situation of a polarization direction of the piezoelectric body 25, driving circuit or the wiring or the like. In all cases, the piezoelectric active part is formed for each pressure chamber 20. In addition, the upper electrode 26 of each piezoelectric element 18 as described above is connected to a lead electrode 27 which is made of gold (Au) or the like.

The protection substrate 19, which has a piezoelectric element holding section 28 which is a space large enough not to inhibit displacement thereof in a region facing the piezoelectric element 18, is joined on the surface of the piezoelectric element 18 side on the pressure chamber substrate 14. Furthermore, the protection substrate 19 has the reservoir section 29 in the region corresponding to the communication section 21 of the pressure chamber substrate 14. The reservoir section 29 is formed in the protection substrate 19 as a through hole having a long rectangular opening shape along the arrangement direction of the pressure chambers 20 and defines the reservoir 30 by communicating with the communication section 21 of the pressure chamber substrate 14 as described above. The reservoir 30 is provided for each type of the ink (for each color) and a common ink is stored in a plurality of the pressure chambers 20.

In addition, a through hole 31, which passes through the protection substrate 19 in the thickness direction, is provided in a region between the piezoelectric element holding section 28 and the reservoir section 29 of the protection substrate 19. A portion of the insulating film 17 and a front end portion of the lead electrode 27 are exposed inside the through hole 31. A compliance substrate 34 configured of a sealing film 32 and a fixing plate 33 is joined on the protection substrate 19. The sealing film 32 is formed of a material (for example, polyphenylene sulfide film) having flexibility. One side surface of the reservoir section 29 is sealed by the sealing film 32. In addition, the fixing plate 33 is formed of a hard material (for example, stainless steel or the like) such as metal. An opening section 35, which passes through in the thickness direction, is formed in a region of the fixing plate 33 opposite to the reservoir 30. Thus, one side surface of the reservoir 30 is sealed by only the sealing film 32 having flexibility.

In the recording head 2 having the configuration described above, the ink is taken from the ink supply unit such as the ink cartridge and is filled from the reservoir 30 to the nozzle 23. Then, an electric field depending on the potential difference of both electrodes between the lower electrode 24 and the upper electrode 26 corresponding to each pressure chamber 20 by supplying the driving signal from the printer body side is given, and the piezoelectric element 18 and the operation surface (the elastic film 16) are deflected. Accordingly, pressure change inside the pressure chamber 20 is generated. The ink is ejected from the nozzle 23 or the meniscus in the nozzle 23 is finely vibrated to the extent that the ink is not ejected by controlling the pressure change.

Figures 3, 4:
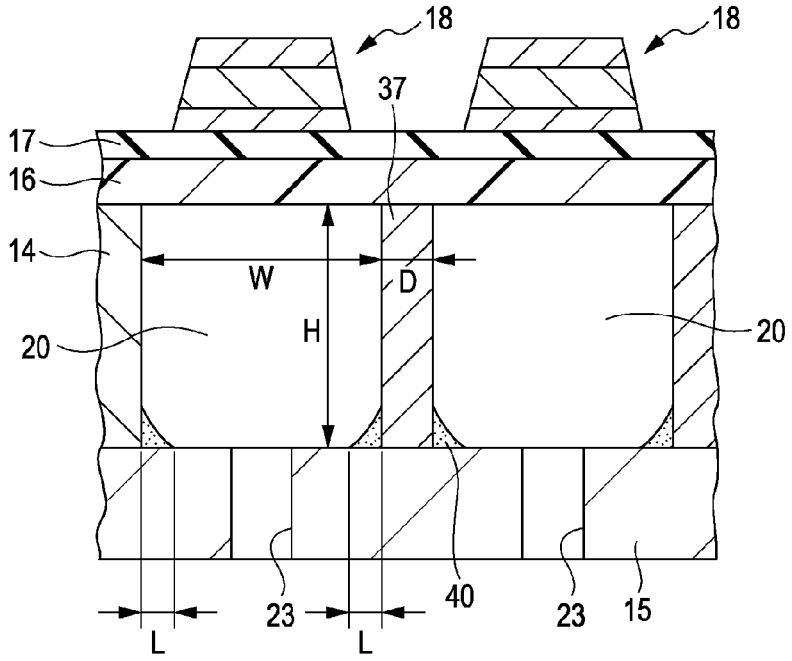
FIG. 3 is an enlarged cross-sectional view illustrating a main portion of the recording head.
FIG. 4 is a table illustrating change in a crosstalk rate and outflow of adhesive when changing a ratio of a protrusion width of the adhesive to the width of the pressure chamber.

Here, in the recording head 2, since it is assumed that an organic solvent-based ink is ejected, a measurement to suppress the crosstalk due to the organic solvent-based ink is carried out. Specifically, the adhesive 40 joining the pressure chamber substrate 14 and the nozzle forming substrate 15 is solidified in a state where the adhesive 40 is actively leaked (protruded) from between the lower end portion of the partition wall 37 and the nozzle forming substrate 15 to the pressure chamber 20 side. In addition, bonding strength between the lower end portion of the partition wall 37 and the nozzle forming substrate 15 is increased. Specifically, as illustrated in FIG. 3, when an inside dimension of the pressure chamber 20 in the arrangement direction of the pressure chambers (the nozzle row direction) is W and a width (hereinafter, referred to as a protrusion width, appropriately) of the adhesive 40 in the arrangement direction of the pressure chambers in a state where the adhesive 40 is flowed out from between the lower end portion of the partition wall 37 and the nozzle forming substrate 15 to the pressure chamber 20 side and then is solidified in a corner portion which is defined by the partition wall 37 and the nozzle forming substrate 15 is L, the coating amount of the adhesive 40 is adjusted so that the ratio of the protrusion width L to the width W of the pressure chamber 20 satisfies the following expression (1).

$$0.05 \leq L/W \leq 0.3 \quad (1)$$

In addition, the protrusion width L of the adhesive 40 indicates the width of one side of the pressure chamber 20 in the protrusion of the adhesive 40 which is generated on both sides in the width direction. Furthermore, in the invention, attention is paid to the protrusion width of the adhesive 40 on both sides of the pressure chamber 20 in the width direction, however, the protrusion of the adhesive 40 is generated similarly on both sides of the pressure chamber 20 in the longitudinal direction thereof.

Regarding the adhesive 40 described above, that a main component thereof is an epoxy-based adhesive which is blended with silica ($SiO_2$) of 5 wt % or more to 10 wt % or less is used. It is possible to increase the resistance to the organic solvent-based ink by using the adhesive 40 to join the pressure chamber substrate 14 and the nozzle forming substrate 15. Specifically, a swelling rate of the adhesive 40 may be 10% or less when the adhesive 40 is immersed in the organic solvent-based ink for 100 hours at a constant temperature, for example, 40° C. Here, the swelling rate is indicated in the following expression (2) when an initial weight of the adhesive 40 is Wt and the weight after a predetermined time has lapsed is Wt' under the state described above.

$$\{(Wt'-Wt)/Wt\} \times 100[\%] \quad (2)$$

In addition, since the bonding force between the lower end portion of the partition wall 37 and the nozzle forming substrate 15 is decreased when the swelling rate is greater than 10% and the partition wall 37 is likely to displace when the partition wall 37 receives the pressure, deterioration of the crosstalk is remarkable.

In the embodiment, after the elastic film 16, the insulating film 17 and the piezoelectric element 18 are formed on the upper surface (a surface opposite to the joining surface of the nozzle forming substrate 15) of the pressure chamber substrate 14, and the flow path such as the pressure chamber 20 or the communication section 21 are formed on the pressure chamber substrate 14 by the etching process, the adhesive 40 is coated on the lower surface of the pressure chamber substrate 14 by film transfer. Here, regarding the adhesive 40, if silica is not added, since the flow property of the adhesive is higher than the conventional adhesive while exhibiting resistance to the ink, there is a drawback that the adhesive may be flowed out to a region other than the region in which the adhesive is required. On the other hand, if the silica is blended in the adhesive 40, the viscosity is high and the outflow described above may be suppressed compared to a case where the silica is not blended. Then, the lower surface of the pressure chamber substrate 14 and the nozzle forming substrate 15 are joined by the adhesive 40 in a state where they are positioned. The protrusion amount of the adhesive 40 toward the pressure chamber 20 side may be controlled by an amount of the adhesive 40 transferred to the pressure chamber substrate 14 and the size of a load when the load is acted between the pressure chamber substrate 14 and the nozzle forming substrate 15 by a jig or the like while the adhesive 40 is dried.

As described above, when the pressure chamber substrate 14 and the nozzle forming substrate 15 are joined by the adhesive 40 described above, the adhesive 40 is solidified in a state where the adhesive 40 is actively leaked from between the lower end portion of the partition wall 37 and the nozzle forming substrate 15 to the pressure chamber 20 side. Accordingly, the bonding strength between the lower end portion of the partition wall 37 and the nozzle forming substrate 15 is increased. Thus, even though the pressure inside the pressure chamber 20 is increased by driving the piezoelectric element 18 to eject the ink from the nozzle 23, the deformation and displacement of the partition wall 37 is suppressed. Accordingly, pressure loss is reduced when the ink is ejected and the crosstalk between adjacent nozzles is suppressed. In other words, change in the ink ejection characteristics (the amount or flying speed of the ink ejected from the nozzle 23) may be suppressed.

FIG. 4 is a table illustrating change in a crosstalk rate and outflow of the adhesive 40 when changing a ratio of the protrusion width L to the width W of the pressure chamber 20. In addition, FIG. 4 illustrates a test result in a temperature (for example, 40° C.) inside the apparatus that is assumed in the use of the printer 1. Here, crosstalk (CT) rate is the degree of the change in the ejection characteristics indicated as a ratio of a flying speed Vm1 of the ink when the ink is ejected from a plurality of nozzles 23 adjacent each other, at the same time (when all is ON) and a flying speed Vm2 of the ink when the ink is ejected from only one nozzle 23 (when one is ON), and is indicated in the following expression (3).

$$CT\text{rate}=(1-Vm2/Vm1)\times 100[\%] \quad (3)$$

For example, when Vm1=10 [m/s] and Vm2=8 [m/s], the crosstalk rate is 20%. In the printer 1, when an image or the like is recorded on the recording medium, the crosstalk rate is required to be at least 40% or less, preferably 30% or less. When the crosstalk rate is greater than 40%, deviation (deviation from the landing position to be target) of the landing position in the recording medium of the ink ejected from the nozzle 23 is remarkable and visual roughness such as so-called granular feelings in the recorded image or the like is outstood. In addition, generally, since the bonding strength by the adhesive is easily varied, the bonding strength has a margin for the crosstalk rate of 40%. In other words, the lower limit of the L/W is calculated on the basis of the crosstalk rate of 30%. In addition, the crosstalk rate may be indicated as a ratio of ink weights Iw when all is ON and when one is ON.

In addition, in a case where the adhesive 40 protrudes to the pressure chamber 20 side more than it needs to be, "outflow"

of the adhesive 40 means a phenomenon in which the protruded adhesive 40 is flowed out to a region other than the region in which the adhesive is required, and means specifically, a phenomenon in which the adhesive 40 moves to the elastic film 16 side along the partition wall by means of the surface tension. Particularly, the outflow of the adhesive 40 is likely to be generated by the capillary force in a portion where partition walls 37 of the pressure chamber 20 cross each other. Then, when the adhesive 40 reaches the elastic film 16 and is hardened, the adhesive 40 regulates the displacement of the piezoelectric element 18 (and the elastic film 16) and it may lead to defective ink ejection. In FIG. 4, a state where there is no outflow is illustrated in ⊙, a state where there is outflow but the adhesive 40 does not reach the elastic film 16 is illustrated in ○, a state where there is outflow and the adhesive 40 reaches the elastic film 16 and then minor defects in the ejection of the ink (the change in the amount of the ink which is ejected or the deviation of the landing position of the ink is within an acceptable range) occurs is illustrated in Δ, and a state where the adhesive 40 reaches the elastic film 16 and remarkable defects in the ejection of the ink (the ink is not ejected from the nozzle 23, or even though ejected, the change in the amount of the ink or deviation of the landing position is greater than the acceptable range) occurs is indicated in x.

As illustrated in FIG. 4, when the ratio of the protrusion width L to the width W of the pressure chamber 20 satisfies the above expression (1), the crosstalk rate is suppressed 20% or more to 30% or less and the outflow of the adhesive 40 was also "⊙" or "○" and then the suppression of the crosstalk may be consistent with the suppression of the outflow of the adhesive. On the other hand, when L/W was less than 0.05, the outflow of the adhesive 40 was suppressed, however, the crosstalk rate was greater than 30%, so that it is incompatible when considering the margin. In addition, it is cleared that when L/W was greater than 0.3, the crosstalk rate may be suppressed to 20%, however, the outflow of the adhesive 40 was generated so that it may be incompatible.

Next, relationships between the height H of the pressure chamber 20, the width W of the pressure chamber 20 and the thickness D of the partition wall 37 will be described.

First of all, relationships between the height H of the pressure chamber 20 and the thickness D of the partition wall 37 will be described. The ratio of the height H of the pressure chamber 20 to the thickness D of the partition wall 37 was set to satisfy the following expression (4)

$$3.8 < H/D \leq 9.0 \quad (4)$$

Figure 5:
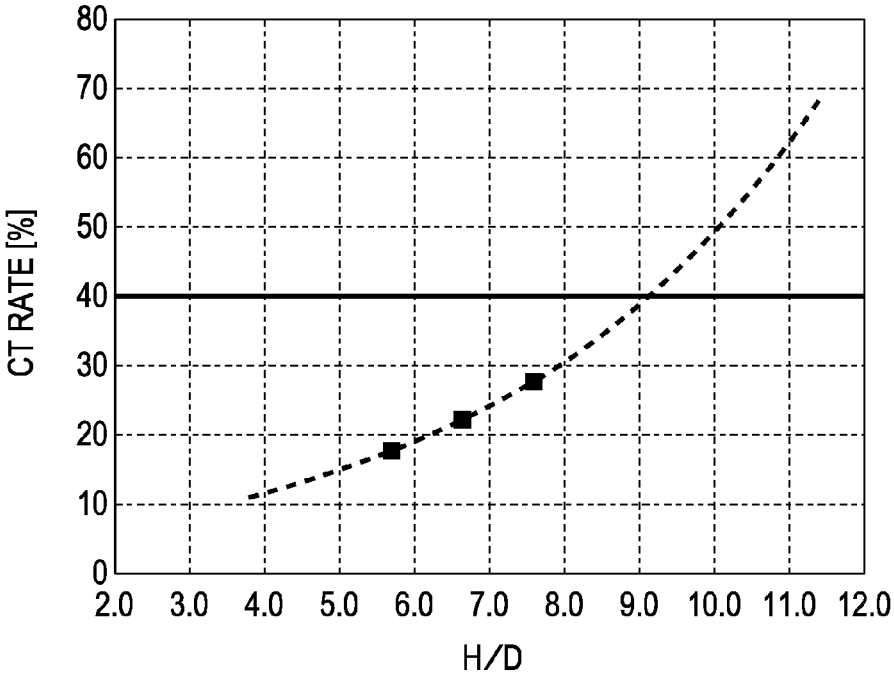
FIG. 5 is a graph illustrating change in the crosstalk rate when changing a ratio of a height of the pressure chamber to a thickness of a partition wall.

FIG. 5 is a graph illustrating change in the crosstalk rate when changing a ratio of the height H of the pressure chamber 20 to the thickness D of the partition wall 37. The lateral axis indicates H/D and the vertical axis indicates the CT rate (see, the expression (3)) in the graph illustrated in FIG. 5. In addition, square points indicate experimental values and a dashed line indicates an approximate curve calculated from the experiment values in the graph illustrated in FIG. 5. In addition, in the experiment, the ratio L/W of the protrusion width L to the width W of the pressure chamber 20 was set to 0.05.

As illustrated in FIG. 5, when H/D is greater than 9.0, it may be seen that the crosstalk rate is greater than 40%. As described above, when the crosstalk rate is greater than 40%, the deviation of the landing position of the ink ejected from the nozzle 23 on the recording medium is remarkable and the visual roughness such as so-called granular feelings in the recorded image or the like is outstood. Thus, it is preferable that the crosstalk rate be suppressed to 40% or less. Here, since the pressure chamber or the partition wall 37 are formed by the anisotropic etching, the variation of the height H of the pressure chamber 20 or the thickness D of the partition wall 37 is small and the variation of the strength of the partition wall 37 itself is also small. Thus, it is not necessary to have a margin for the crosstalk rate as the lower limit of L/W described above and the upper limit of the H/D is calculated on the basis of the crosstalk rate of 40%.

In addition, as illustrated in FIG. 5, it may be seen that the smaller H/D becomes the more the crosstalk rate is likely to be improved. However, it is seen from the experiment that when H/D is 3.8 or less, the volume of the pressure chamber 20 is reduced and the amount of the ink per unit time ejected from the nozzle 23, that is, the ejection efficiency of the ink is deteriorated. Thus, it is not preferable that H/D is set to 3.8 or less.

In other words, the strength of the partition wall 37 itself may be increased while sufficiently securing the ejection amount of the ink by setting the ratio of the height H of the pressure chamber 20 to the thickness D of the partition wall 37 to satisfy the expression (4) in addition to the expression (1) described above. As a result, the control of the crosstalk can be performed further accurately.

Meanwhile, in a case where pitches between the nozzles in the nozzle row direction are the same as each other, when the thickness D of the partition wall 37 is thick, the width W of the pressure chamber 20 is relatively narrow. When attention is paid to the ratio of the height H of the pressure chamber 20 to the width W of the pressure chamber 20, the ratio is set to satisfy the following expression (5).

$$0.7 < H/W \leq 1.6 \quad (5)$$

Figure 6:
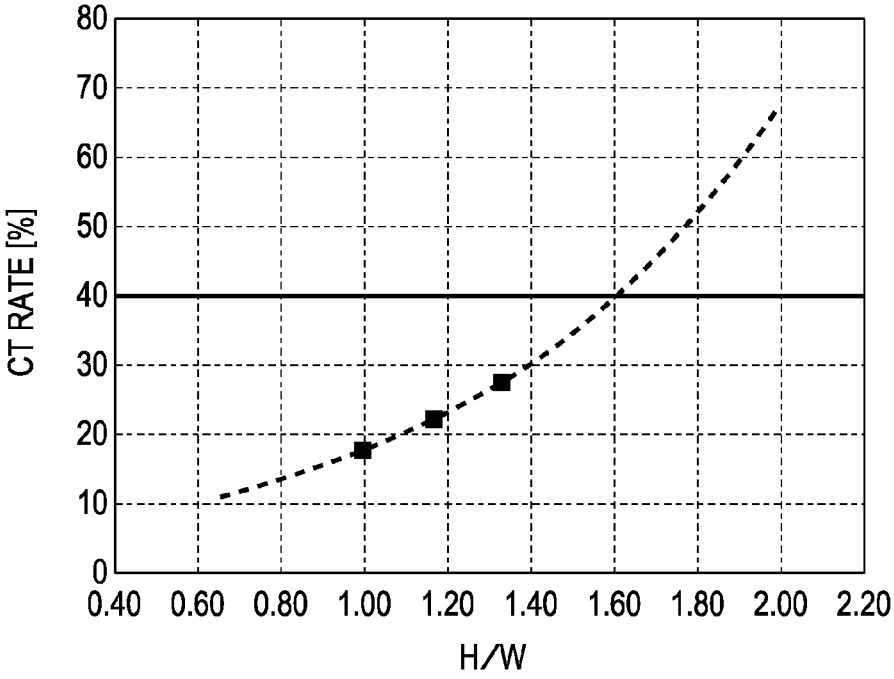
FIG. 6 is a graph illustrating a change in the crosstalk rate when changing a ratio of the height of the pressure chamber to the width of the pressure chamber.

FIG. 6 is a graph illustrating a change in the crosstalk rate when changing a ratio of the height H of the pressure chamber 20 to the width W of the pressure chamber 20. The lateral axis indicates H/W and the vertical axis indicates the CT rate (see, the expression (3)) in the graph illustrated in FIG. 6. In addition, square points indicate experimental values and a dashed line indicates an approximate curve calculated from the experiment values in the graph illustrated in FIG. 6. In addition, in the experiment, the ratio L/W of the protrusion width L to the width W of the pressure chamber 20 was set to 0.05.

As illustrated in FIG. 6, when H/W is greater than 1.6, it may be seen that the crosstalk rate is greater than 40%. As described above, it is preferable that the crosstalk rate be suppressed to 40% or less. In addition, it is not necessary to have a margin to the crosstalk rate in H/W, similarly in H/D. Thus, the upper limit of the H/W is calculated on the basis of the crosstalk rate of 40%.

In addition, as illustrated in FIG. 6, it may be seen that the smaller H/W becomes the more the crosstalk rate is likely to be improved. However, it is seen from the experiment that when H/W is 0.7 or less, the volume of the pressure chamber 20 is reduced and the amount of the ink per unit time ejected from the nozzle 23, that is, the ejection efficiency of the ink is deteriorated. Thus, it is not preferable that H/W is set to 0.7 or less.

In other words, the crosstalk may be further reliably suppressed while sufficiently securing the ejection amount of the ink by setting the ratio of the height H of the pressure chamber 20 to the width W of the pressure chamber 20 to satisfy the expression (5) in addition to the expressions (1) and (4) described above.

Furthermore, in the embodiment described above, as the pressure generation unit, a so-called flexible vibration type piezoelectric element 18 is exemplified, however, the invention is not limited to the embodiment. For example, the invention may employ a so-called vertical vibration type piezoelectric element. In addition, the invention may be applied to a configuration which employs a pressure generation unit such as a heating element which generates a pressure change by generating air bubbles by heating or an electrostatic actuator which generates the pressure change by displacing an operation surface of a pressure chamber using the electrostatic force.

Further, the invention is not limited to the printer and may be applied to various ink jet type recording apparatus such as a plotter, a facsimile machine, copier, or a liquid ejecting apparatus other than the recording apparatus, for example, a display manufacturing apparatus, an electrode manufacturing apparatus and a chip manufacturing apparatus, if the liquid ejecting head ejects the liquid such as the ink from the nozzle by defining a plurality of pressure chambers using the partition walls and by displacing the operation surface which seals the opening surface of the pressure chamber using the pressure generation unit, and the liquid ejecting apparatus includes the liquid ejecting head.

What is claimed is:

1. A liquid ejecting head comprising:

a nozzle configured to eject liquid;

a pressure chamber in communication with the nozzle;

a pressure chamber substrate in which a plurality of pressure chambers are defined by partition walls;

a pressure generation unit which generates a pressure change in a liquid inside the pressure chamber; and a bottom member which is joined to the pressure chamber substrate by adhesive and defines the bottom portion of the pressure chamber, wherein the liquid having a compressibility greater than a compressibility of water is ejected from the nozzle by driving the pressure generation unit and by generating the pressure change in the pressure chamber, and wherein when a width of the pressure chamber in an arrangement direction of the pressure chambers is W, and a width of the adhesive in the arrangement direction of the pressure chambers in a state where the adhesive is flowed out from between a lower end portion of the partition wall and the bottom member to the pressure chamber side and then is solidified in a corner portion which is defined by the partition wall and the bottom member is L, the following expression is satisfied, $$0.05 \leq L/W \leq 0.3.$$

2. The liquid ejecting head according to claim 1, wherein when a width of the partition wall in the arrangement direction of the pressure chambers is D and a height of the pressure chamber in a lamination direction of the pressure chamber substrate and the bottom member is H, the following expression is satisfied, $$3.8 < H/D \leq 9.0.$$

3. A liquid ejecting apparatus including the liquid ejecting head according to claim 2.

4. The liquid ejecting head according to claim 1, wherein when a height of the pressure chamber in the lamination direction of the pressure chamber substrate and the bottom member is H, the following expression is satisfied, $$0.7 < H/W \leq 1.6.$$

5. A liquid ejecting apparatus including the liquid ejecting head according to claim 4.

6. The liquid ejecting head according to claim 1, wherein the liquid has an organic solvent as a solvent and a swelling rate of the adhesive is 10% or less when the adhesive is immersed in the liquid for 100 hours under a constant temperature of 40° C.

7. A liquid ejecting apparatus including the liquid ejecting head according to claim 6.

8. The liquid ejecting head according to claim 1, wherein the adhesive is made by an epoxy-based adhesive blended with silica of 5 wt % or more to 10 wt % or less.

9. A liquid ejecting apparatus including the liquid ejecting head according to claim 8.

10. A liquid ejecting apparatus including the liquid ejecting head according to claim 1.

* * * * *